United States Patent [19]

Wong

[11] 3,984,883

[45] Oct. 12, 1976

[54] PULL OUT SOFA BED AND HARDWARE THEREFOR

[75] Inventor: John Wong, Jersey City, N.J.

[73] Assignee: Mohasco Corporation, Amsterdam, N.Y.

[22] Filed: Apr. 17, 1975

[21] Appl. No.: 568,729

[52] U.S. Cl. ..... 5/13; 5/29

[51] Int. Cl.[2] ..... A47C 17/14

[58] Field of Search ..... 5/13, 28, 29, 37

[56] References Cited

UNITED STATES PATENTS

| | | | |
|---|---|---|---|
| 3,298,041 | 1/1967 | Rogers, Jr. | 5/13 |
| 3,380,083 | 4/1968 | Mikos | 5/13 |
| 3,740,775 | 6/1973 | Metayer | 5/13 |

*Primary Examiner*—Casmir A. Nunberg
*Attorney, Agent, or Firm*—J. B. Felshin

[57] ABSTRACT

This pull-out sofa bed comprises a metal bed provided with a head section that can be raised to T.V. position, and releasably locked in such position, or released from such position and lowered to sleeping position, or folded over an adjacent long intermediate section of the bed to underlie the foot section of the bed folded thereover and also over said intermediate section, for compactness when shipping the bed. This bed has rear legs foldable underneath the intermediate section when the bed is fully collapsed, and also has means contacting the underside of the collapsed rear legs, to support the folded bed in a plurality of selected vertical levels of the sofa seat when the pull-out bed is collapsed and used as a sofa. The bed has means for locking the foot section of the bed to the intermediate section, in the folded or collapsed condition of the bed, to compress the mattress, which means is highly simplified and easy to manufacture. Further, the bed includes front legs, and means which could be separately shipped and which could be attached to the front legs by the upholsterer of the bed, to increase the stability of the bed in sleeping position.

33 Claims, 14 Drawing Figures

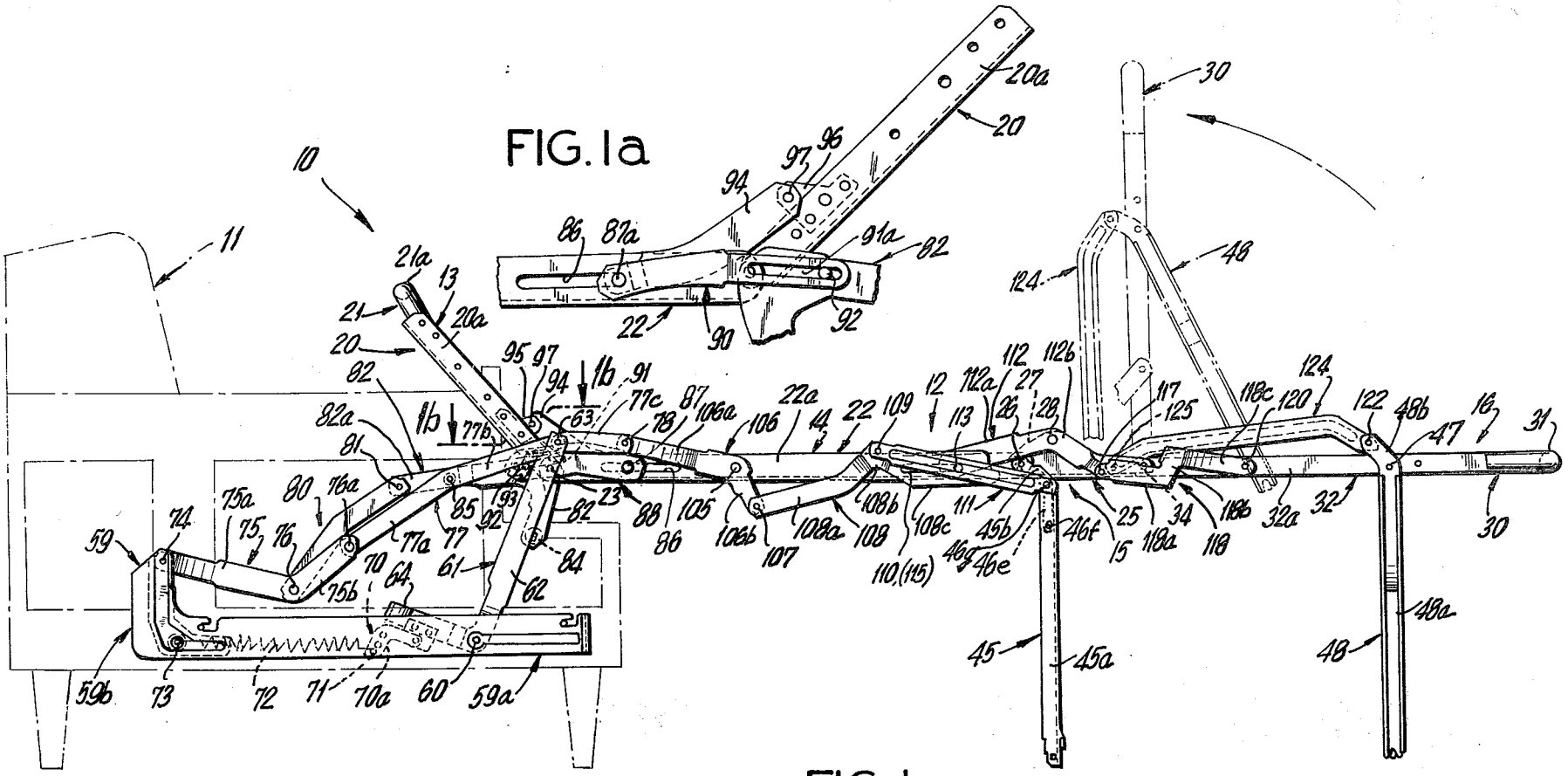
FIG. 1a
FIG. 1
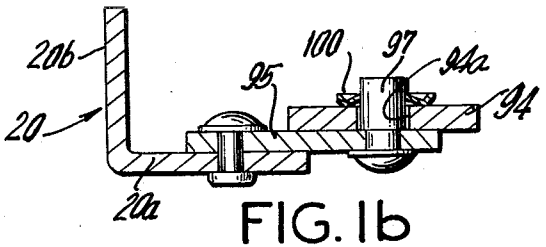
FIG. 1b

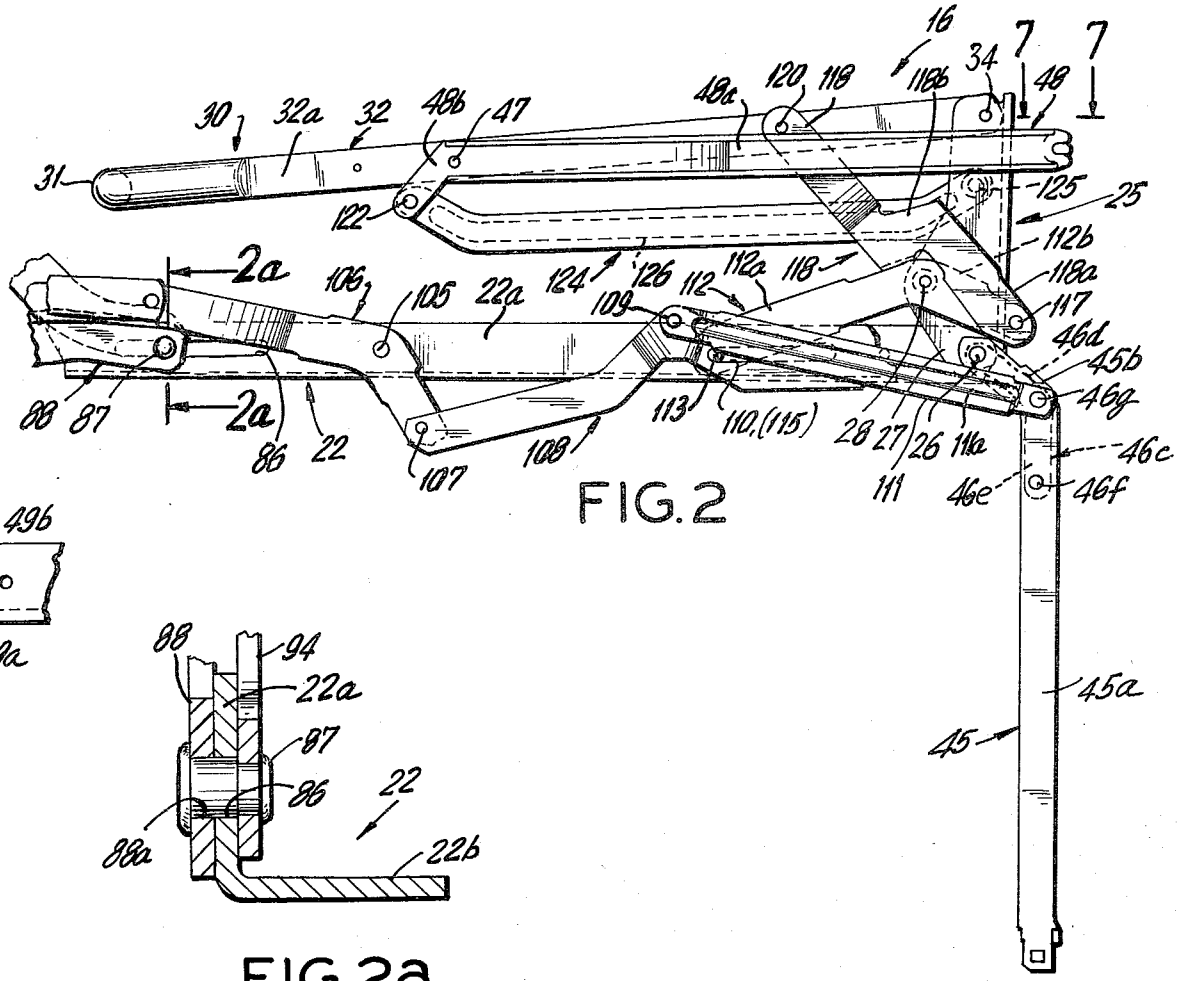
FIG. 2
FIG. 2a
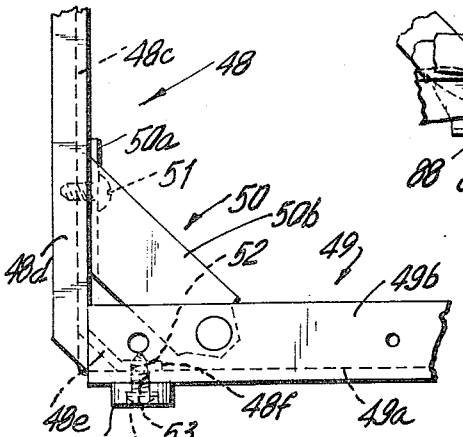
FIG. 7

PULL OUT SOFA BED AND HARDWARE THEREFOR

This invention relates to pull out sofa beds and hardware therefor.

An object of this invention is to provide a pull out sofa bed of the character described having a head section which can be raised to T.V. position and releasably locked in such position and released and lowered to sleeping position and which also can be released for swinging in overlying position relative to an adjacent long intermediate bed section, over which the front section of the bed can be folded with the bed is collapsed, to allow for a more compact collapsed bed to facilitate shipping thereof.

Another object of this invention is to provide a pull out sofa bed of the character described having means to vary the height of the sofa seat.

Yet another object of this invention is to provide in a sofa bed of the character described, highly improved and simplified means for locking the bed in collapsed or fully folded condition to compress a mattress therebetween.

Still another object of this invention is to provide a pull out sofa bed of the character described having means which can be shipped separately from the main bed, and which is attachable to the front legs of the bed, for increasing the stability of the bed when the bed is pulled out to sleeping position.

A further object of this invention is to provide a strong, rugged and durable pull out sofa bed of the character described and hardware therefor, which shall be relatively inexpensive to manufacture, easy to manipulate, which shall be stable when in sleeping condition, which will be securely locked against opening up, when in collapsed or folded condition to compress the matress, and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

In the drawings:

FIG. 1 is a side elevational view of a pull out sofa bed embodying the invention with the bed in fully pulled out or sleeping position, and with the head of the bed at the left end, and with the head section of the bed in raised T.V. position, and showing the foot section of the bed in raised position in dot-dash lines;

FIG. 1*a* is a partial view of the connection between the head section in raised T.V. position, and the intermediate section, but on the side of the bed opposite to the side shown in FIG. 1;

FIG. 1*b* is a cross-sectional view taken on line 1*b*—1*b* of FIG. 1;

FIG. 2 is a partial view of the bed showing the foot section of the bed in horizontal position, above the long intermediate section, (which is adjacent to the head section,) and with the short intermediate section, which connects the long intermediate section with the foot section, in vertical upfolded position;

FIG. 2*a* is a cross-sectional view taken on line 2*a*—2*a* of FIG. 2;

FIG. 3 is a view like FIG. 1, but showing the bed in inclined position between the FIG. 2 position and the fully collapsed position of FIG. 4, and in downwardly and rearwardly inclined position;

FIG. 3*a* is a cross-sectional view taken on line 3*a*—3*a* of FIG. 3, but showing attachment of an angle to raise the sofa seat to the highest level, when the bed is fully collapsed and used as a sofa;

FIG. 3*b* is a cross-sectional view taken on line 3*b*—3*b* of FIG. 3*a;*

FIG. 3*c* is a view similar to FIG. 3*a* but showing attachment of said angle to raise the sofa seat to a lesser height;

FIG. 4 is a view similar to FIG. 3, but showing the bed in fully collapsed condition;

FIG. 5 is a partial view showing the connection of the head section to the adjacent long intermediate section, but with the head section disconnected from a link, which permits the head section to be infolded down in overlying position relative to the long intermediate section, with the head section between the intermediate section and foot section, which is folded to overlie the infolded head section and said intermediate section, to facilitate shipping the bed in more compact fully collapsed condition;

FIG. 7 is a partial view taken on line 7—7 of FIG. 2; and

Figure 3B:
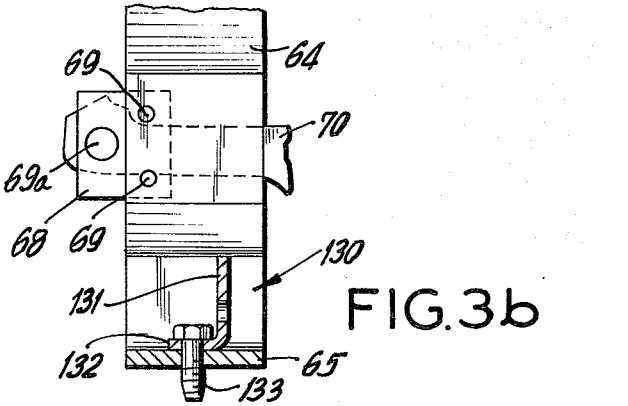

Referring now in detail to the drawing, 10 designates a pull out sofa bed comprising a sofa bed wood frame 11 to which a metal foldable or collapsible bed 12 is connected.

Said bed 12 comprises a rear head section 13, a long intermediate section 14 pivotally connected at one end to said head section, a short intermediate section 15 pivotally connected at one end to the other end of said long intermediate section 14, and a front foot section 16 pivotally connected to the other end of said short intermediate section.

The head section 13 (see FIG. 6) comprises left and right rear side angles 20 which are similar and symmetrically disposed, and interconnected by a T.V. end cross tube 21. The end tube 21 comprises a transverse tubular portion 21*a* from the ends of which short arms 21*b* extend. Said arms 21*b* are riveted to adjacent ends of the rear side angle 20. Each rear side angle 20 has a flange 20*a* extending upwardly from the outer end of an inwardly extending horizontal flange 20*b*.

Member 21 is made of tubular stock and its tubular arms 21*b* are each flattened into angular shape to form a vertical flange and a horizontal flange and which are interfitted with and riveted to adjacent ends of the vertical flange 20*a* and horizontal flange 20*b* of a rear side angle 20.

The long intermediate section 14 comprises similar, symmetrically disposed left and right main angles 22, each having an outer vertical flange 22*a* extending up from an outer end of a lower inwardly extending horizontal flange 22*b*. The vertical flanges 20*a* are pivoted at their right ends by rivets 23 to the left ends of flanges 22*a*.

The short intermediate section 15 comprises left and right similar, symmetrically disposed center angles 25, each comprising a vertical outer upwardly extending flange 25*a* and a lower, inwardly extending horizontal flange 25*b*. The right ends of flanges 22*a* of the main angles 22, are hinged to the left ends of flanges 25*a* of the center angles 25, by pivot rivets or pins 26. Vertical flanges 25*a* have upward triangular extensions 27 rising above the level of the upper edges of flanges 22*a* and carry a pivot rivet or pin 28 at the apex of said extension, for the purpose hereinafter appearing.

Figure 6:
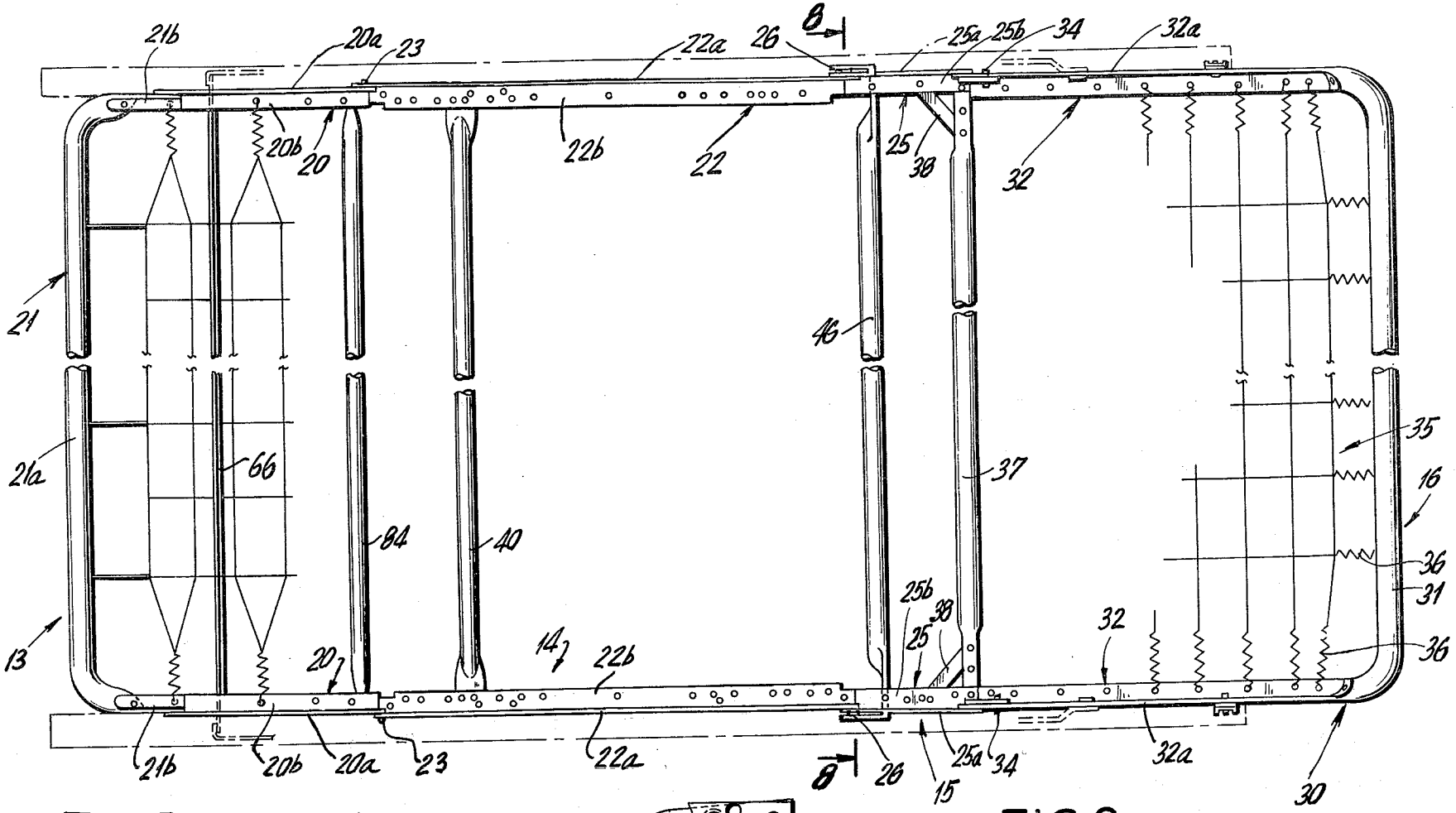
FIG. 6 is a top plan view of the fully opened up bed in sleeping position.

The foot section 16 comprises a front member 30 of tubular stock, comprising an end tube portion 31 from which parallel tube portions 32 extend. The parallel tube portions 32 are compressed to form flattened vertical flanges 32*a* pivotally connected at their left ends to right ends of flanges 25*a* of the center angles by pivot pins or rivets 34. Portions 32 are horizontal when the bed is pulled out and in sleeping position, as shown in FIGS. 1 and 6.

The sections 13, 14, 15 and 16 together form a rectangular frame with curved corners, when the bed is fully pulled out. Attached to said frame is a linkage to form a usual platform 35 or support for a mattress (not shown). The platform is connected to the frame in the usual manner by coil tension springs 36 to support the mattress.

The center angles 25 are connected together by a cross tube 37 riveted at its ends to said center angles and reinforced by angled braces 38.

The main angles 22 are interconnected by a cross tube 40 fixed at its ends to said angles.

Pivoted to pivot pins or rivets 26 are similar, symmetrically disposed rear legs 45 each having a long vertical portion 45*a* (when the bed is fully pulled out), and an upwardly and rearwardly inclined portion 45*b*, the upper end of which is pivoted to said pin 26. A rear leg patch 46*c* reinforces the upper end of leg 45. It has a top arm 46*d* inclined upwardly and rearwardly, like arm 45*b* of the leg 45, and a lower arm 46*e* alongside the upper end of leg portion 45*a*. Patch 46*c* receives pivot 26 and is riveted to the rear leg as at 46*f*. At the junction of arms 46*d*, 46*e* of patch 46*c* is a pivot pin 46*g* for the purpose hereinafter appearing.

Figure 8:
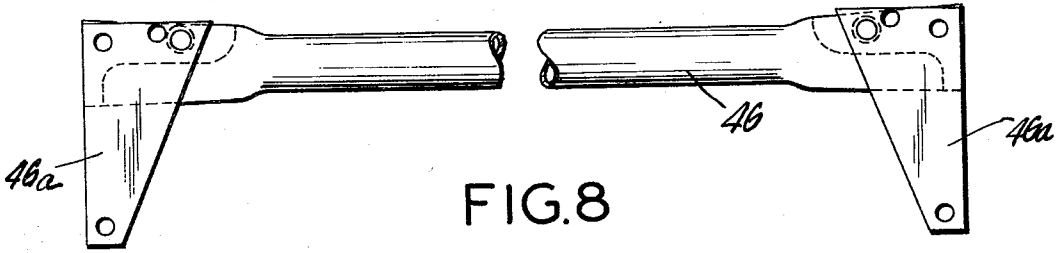
FIG. 8 is a cross-section taken on line 8—8 of FIG. 6.

Legs 45 may be interconnected by a rear leg cross tube 46, through triangular end plates 46*a* attached to said rear legs in any suitable manner as shown in FIG. 8. Tube 46 may be located below the level of angles 25.

Pivoted to legs 32 of member 30 as on pivot pins or rivets 47 are similar symmetrically disposed front legs 48, each having a vertical long portion 48*a* (when the bed is fully pulled out) and a short upwardly and rearwardly inclined portion 48*b* at the upper end of portion 48*a*, (FIG. 7).

Means is provided to interconnect the lower ends of said front legs 48. Said front legs each have a flange 48*c* in a vertical longitudinal plane and a flange 48*d* in a vertical transverse plane. Said flange 48*c* is formed at its lower end with a web 48*e* inclined downwardly and inwardly and from which a horizontal tongue or flange 48*f* extends inwardly. Interconnecting flanges 48*b* is a cross angle bar 49 having a lower horizontal flange 49*a* and a vertical upstanding flange 49*b*. Angle corner braces or gussets 50 interconnect the lower ends of legs 48 with the outer ends of cross bar 49. Each angle brace 50 comprises a flange 50*a* screwed to flange 48*c*, by a self tapping screw 51, a downwardly and inwardly inclined flange 50*b* in a transverse plane, and overlapping flange 49*b*. Flange 48*f* of each leg contacts the upper side of flange 49*a*. Flanges 48*f*, 49*a* have registering openings 52, 53 at each end of the cross bar 49. A recessed bumper 54 is attached to each end of the cross bar 49 by a self tapping screw 55 as shown in FIG. 7. It will now be understood that braces 50 may be pre-fixed to cross bar 49 and shipped separately with self tapping screws 51 and 55 and bumpers 54. The customer or upholsterer can then attach the braces 50 to the legs and the bumpers to the cross bar by means of the self tapping screws 55.

Figure 3A:
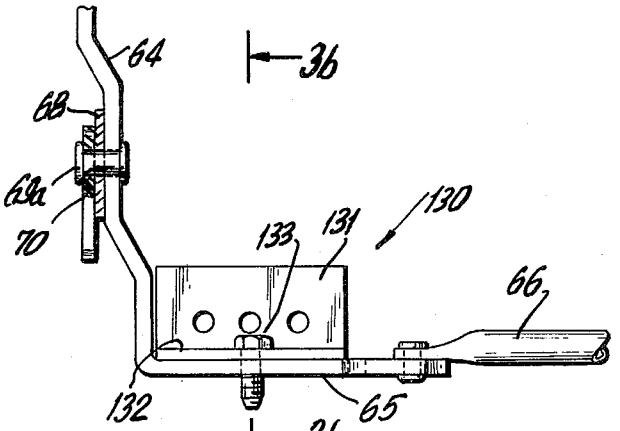
Figure 3C:
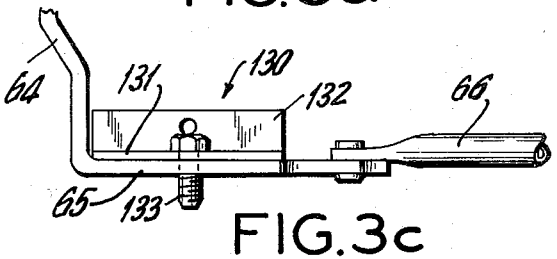
Figure 3:
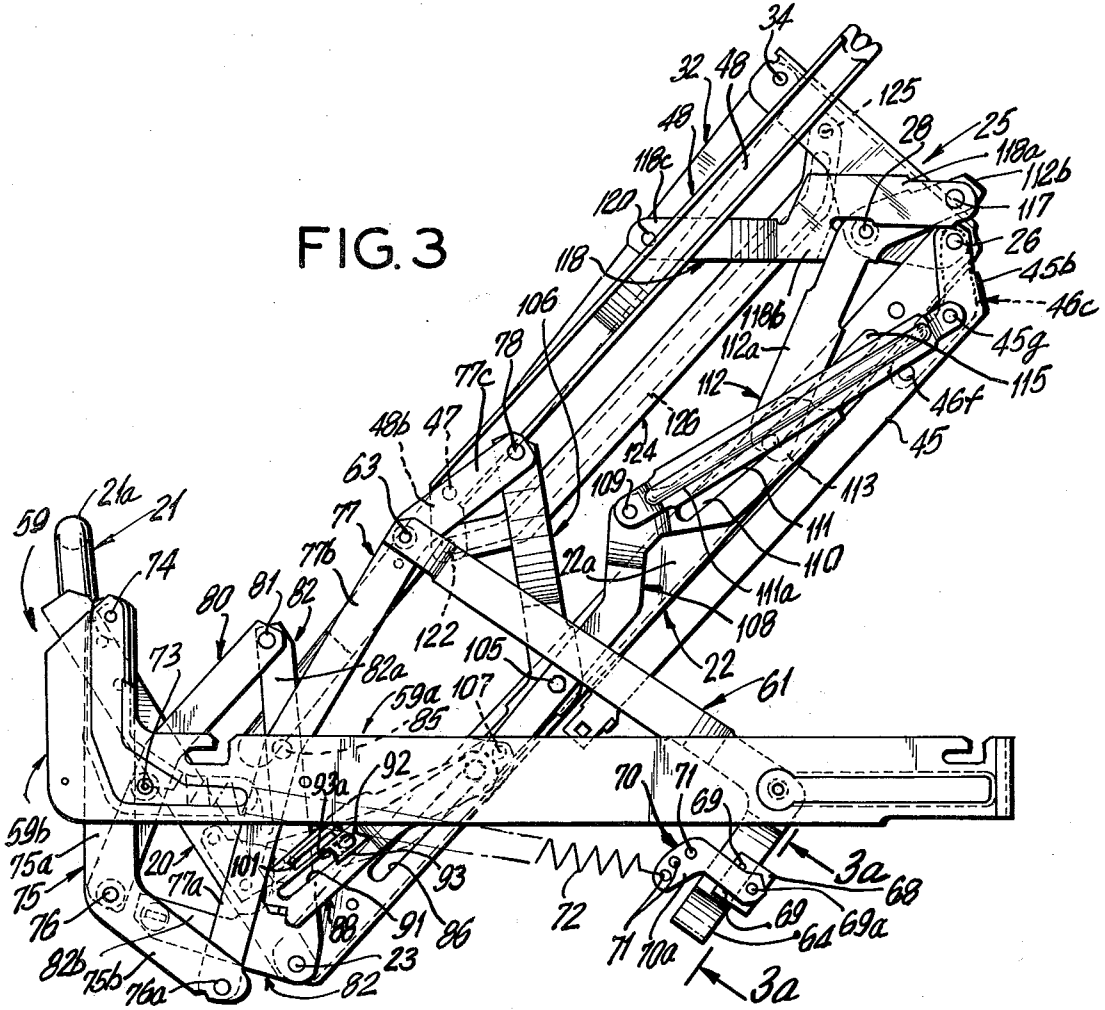
Figure 4:
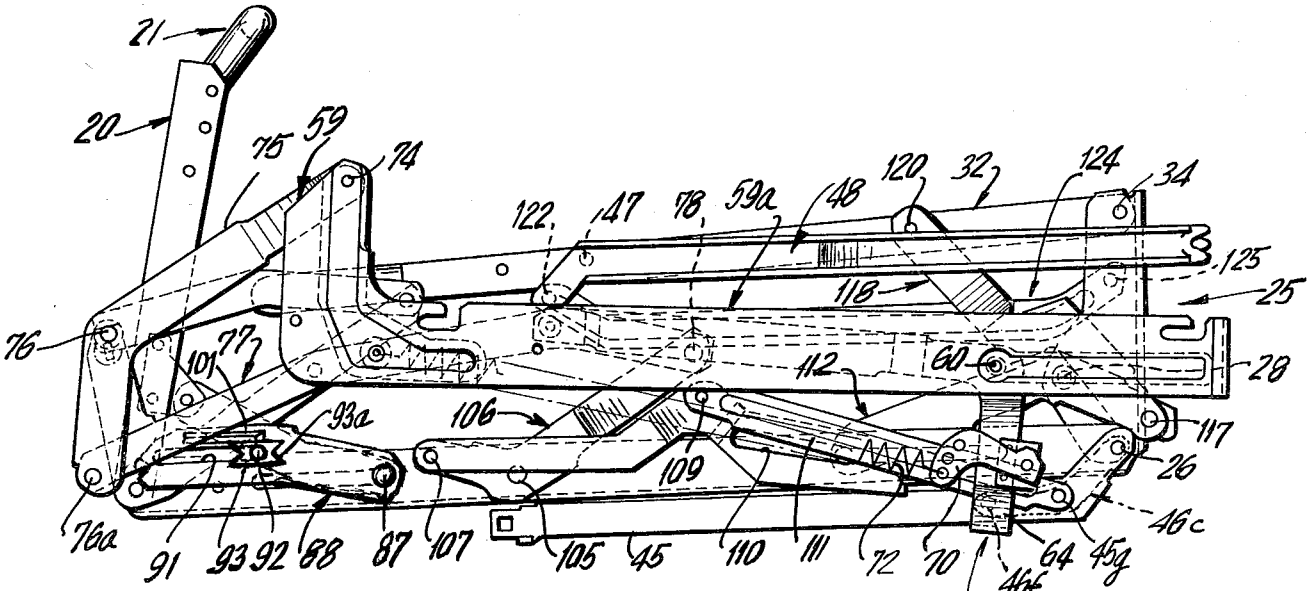

Means is provided to connect the bed sections 13, 14, 15, 16 and the legs 45, 48 in such manner that the bed will be supported in pulled out condition for sleeping, connected to a right chassis 59 and a left chassis 59, both fixed to the wood bed frame 11, and can be collapsed by first upfolding the foot section 16 through an angle of 90° to the dot-dash position of FIG. 1, then swinging the upfolded foot section 16 and the short intermediate section 15, together through an angle of 90° to position of FIG. 2, and then first moving the bed from the position of FIG. 2 to the position of FIG. 3 and then to fully collapsed position of FIG. 4.

The chassis 59 on both sides of the bed are similar and symmetrically disposed. Since the means which connects the longitudinal portions of the bed frame on the right and left facing sides of the bed, are similar and symmetrically disposed, except for some differences to be described hereinafter, only the connections on one side will be described. The side shown in FIGS. 1, 2, 3 and 4 is the left facing side of the bed, which is the side on the left side of a person standing in front of the foot end of the bed and looking toward the head end of the bed. The connections are shown when a person standing at the left facing side of the bed looks toward the outside of the left facing side of the bed.

The chassis 59 (FIG. 1) is in a vertical plane, and has a horizontally extending portion 59*a* from the left end of which a vertically extending portion 59*b* projects upwardly. Pivoted to portion 59*a* of the chassis, as at 60 is a main lever 61. The chassis can be fixed to the wood frame 11 in any suitable usual manner. Said lever 61 comprises an arm 62 extending up from pivot 60. Said arm 62 inclines upwardly and to the right (forwardly) as shown in FIG. 1, to a height above pivot 23, and carries a pivot pin or rivet 63 at its upper end. Extending from the lower end of arm 62 is an arm 64 which inclines upwardly to the rear in the FIG. 1 (sleeping) position of the bed. Extending from arm 64, inwardly or transversely of the bed is an arm 65 (see FIGS. 3*a*, 3*b*, 3*c*). Arms 65, on opposite sides of the bed, are interconnected by a cross stop strip 66.

Attached to arm 64 is a plate 68 riveted to said arm 64 by rivets 69 or any other suitable attaching devices. Plate 68 projects down beyond and below arm 64 in the FIG. 1 position of the bed. The projecting portion of plate 68 carries a pivot 69*a* to which there is pivoted a tension link 70 of angular shape and having a leg 70*a* formed with 3 holes 71 in a row. A coil tension spring 72 connects a selected one of the holes 71 with an anchoring pin 73 on arm 59*a* of the chassis, close to arm 59*b*. Spring 72 biases the main lever 61 to rotate in a clockwise direction (FIG. 1).

Pivoted to the upper end of arm 59*b* of chassis 59, as at 74, is a rear swing link 75 having an arm 75*a* inclined downwardly and forwardly as shown in FIG. 1, and an arm 75*b* inclined upwardly and forwardly from its junction with said arm 75*a*. At such junction is a pivot pin 76. Pivoted to the forward end of arm 75*b*, as at 76*a*, is a rear throwout link 77. Link 77 has a first straight arm 77*a* inclined upwardly and forwardly, a second straight arm 77*b* inclined upwardly and forwardly from the forward end of arm 77*a*, but at a lesser angle to the horizontal.

The upper end of the arm 62 of the main lever 61 is pivoted to said pivot 63. Extending from the forward end of arm 77*b* is an arm 77*c* inclined slightly downwardly and forwardly and carrying a pivot pin 78 at its forward end disposed just above angle 22 of the long intermediate section 15.

Pivoted to pivot 76, at the junction of arms 75*a*, 75*b* of lever 75, is one end of rear control link 80, which, as shown in FIG. 1, projects upwardly and forwardly and is located above pivot pin 76*a*. Pivoted to the forward end of link 80, as at 81, is a rear guide link 82, shaped like a bellcrank, and having a first arm 82*a* inclined slightly upwardly and extending forwardly, as shown in FIG. 1, and being pivoted to said pivot pin 23, and having a downwardly and rearwardly inclined arm 82*b*. The lower ends of arms 82*b* on opposite sides of the bed are interconnected by a cross tube 84, (see FIG. 6).

Link 77 crosses link 82 at the junction of arms 77*a*, 77*b* of said link 77, and is pivoted to arm 82*a* of said link 82 where they cross, by pivot pin 85.

Figure 5:
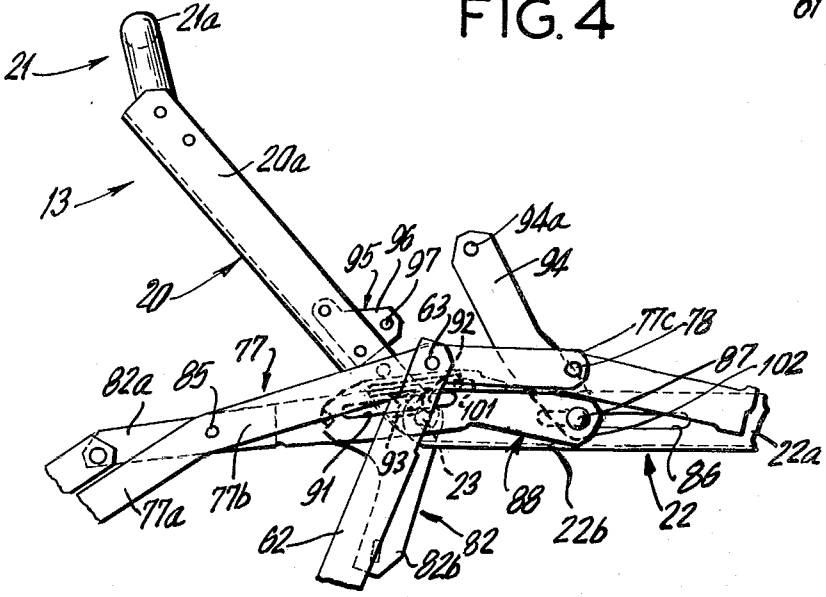

Flange 22*a* of angle 22 is formed with a longitudinal slot 86 (FIG. 2). Rotatably and slidably extending through said slot 86 is a pin 87 passing through a hole 88*a* in the right end of a latch 88 as shown in FIGS. 1, 5 and 2*a*. Latch 88 is only located at the left facing side of the bed, that is at the side of the bed which is on the left side of a person standing in front of the foot of the bed and facing the bed. At the right facing side of the bed a latch 90 replaces the latch 88 and is illustrated in FIG. 1*a* of the drawing.

The latch 88 is formed at its left end (FIG. 5) with a longitudinal slot 91 receiving a pin 92 fixed to arm 82*a* of rear guide link 82. Rotatable on pin 92, at one end thereof, is a latch butterfly member 93 having V-shaped notches 93*a* at its opposite ends. Pin 87 interpivots latch 88 to a T.V. support link 94 formed with a hole 94*a* at its outer end. Fixed to flange 20*a* of rear side angle 20 is a bracket 95 having a tongue 96 projecting beyond said flange and carrying a pin 97 disconnectably engageable in hole 94*a* of link 94. When link 94 is disconnected from pin 97, it can be swung away from angle 20 which can then be swung clockwise, looking at FIGS. 1 and 5, to overlie section 14 of the bed, and to allow foot section 16 to be swung up and then allow sections 15 and 16 to be folded together, with section 16 disposed over section 14 and the inwardly and downwardly folded section 13, to make a compact package to facilitate shipment.

When the bed is unfolded, pin 97 may be replaced, as shown in FIG. 1*b*, the T.V. support link reengaged with the pin, and a spring retainer washer 100 pressed onto the projecting portion of the pin, as shown in FIG. 1*b*, to keep the T.V. support link hinged to the angle 20. The head section 13 of the bed may then be swung back to sleeping position, in the horizontal plane of the extended sections 14, 15, 16, or the head secton may be lifted to T.V. position, and locked in such position.

The butterfly 93 cooperates with a longitudinal ridge 101 on latch 88, located above slot 91 and formed with an end offset lug 102 on said latch, to allow the head section to be lifted above its T.V. position and then swung back somewhat, to its T.V. position and be locked in such position as shown in FIG. 1 then to be raised again and then swung back all the way to horizontal or sleeping position. Such butterfly mechanism is old, as shown in U.S. Pat. No. 3,281,870 granted Nov. 1, 1966, which shows a butterfly 60 cooperating with a member 46 provided with a ridge 61 and a lug 62 which correspond to the ridge 101 and lug 102 herein. Since such mechanism and its operation is explained in said U.S. Pat. No. 3,281,870 and it well known, it need not be repeated herein. The butterfly is alternately rotated from non-locking to locking and from locking to non-locking positions on successive oscillations of the head section 13 of the bed. As the head section is swung rearwardly and downwardly, latch member 88 moves rearwardly and pin 92 moves in the slot 91 of saif latch (FIG. 5) rearwardly, guided by pin 92 on rear guide link 82.

On the right facing side of the bed, latch 90, which is like latch 88 except that it has no butterfly 93, no ridge 101 and no lub 102, moves longitudinally of the bed, same as latch 88, since it has a slot 91*a* like slot 91 receiving a pin 92 on rearguide link 82 and it has a pin 87*a* like pin 87 received in slot 86 in the main angle on the right facing side of the bed, which pin 87*a* interpivots latches 90 and 94 on the right facing side of the bed.

Pivoted to the flange 22*a* of main angle 22, as on pivot 105 (FIG. 1), is a main bellcrank 106 having a rearwardly and upwardly extending arm 106*a* pivoted to arm 77*c* of the rear throwout link 77 by said pivot pin 78. Said main bellcrank 106 also has an arm 106*b* projecting forwardly and more steeply downwardly as seen in FIG. 1, and carrying a pivot 107 at its lower end. Pivoted to said pivot 107 is one end of a slotted lock link 108. Said link 108 has a downwardly and rearwardly slanting arm 108*a*, the rear end of which is pivoted to said pivot 107. Extending from said arm 108*a* is an upwardly projecting inverted V-shaped midportion 108carrying a pivot 109 at its apex. Said pivot 109 is located at a height just above flange 22*a* of main angle 22. Extending forwardly from said inverted V shaped portion 108*b* is an arm 108*c* which is substantially in the horizontal plane of flange 22*a* (FIG. 1) and terminating short of said pivot 26. Arm 108*c* is formed with a longitudinal slot 110. Interconnecting pivot pins 109 and 46*g* is a rear leg link 111 which may have longitudinal reinforcing embossing as shown at 111*a* in FIG. 1.

Pivoted to pivot pin 28 on central angle 25, is a main lock link 112 having an arm 112*a* projecting rearwardly and downwardly, in the FIG. 1 position of the bed, and carrying at its rear end, a pin 113 slidable in slot 110 of arm 108*c* of slotted lock link 108, and also in a slot 115 in the main angle. Slot 115 in the main angle and slot 110 in arm 108*c* of the slotted lock link 108, register when the bed is in the fully extended or open position thereof. They thus coincide in FIG. 1, but can be separately seen in FIG. 3. In FIG. 1, pin 113 is at the front ends of slots 110, 115. In FIG. 2, with the foot section lying over the long intermediate section 14, said pin 113 is at the rear ends of said slots 110, 115.

The main lock link 112 has a forwardly and downwardly inclined arm 112*b* pivoted at its forward end by a pivot 117, to a front tube or foot section lock link 118. Link 118 is zig-zag in shape, having an arm 118*a* inclined downwardly somewhat and forwardly from the pivot 117. Extending from the forward end of arm 118*a* is a short upwardly and forwardly inclined offsetting intermediate portion 118*b*. Extending from the upper end of portion 118*b* is an arm 118*c* projecting downwardly and forwardly in parallel, offset relation to arm 118*a*. The right end of arm 118*c* is pivoted, as at 120, to arm 32 of tubular foot section 30.

At the upper end of arm 48*b* of the front leg 48 is a pivot 122 connected by a front leg link 124 to a pivot 125 on the center angle 25, lying between pivots 34 and 117 when the bed is in its fully extended position of FIG. 1. Said front leg link 124 may be embossed longitudinally for reinforcement, as shown at 126 in said figure.

In the FIG. 2 position of the chair, the mattress (not shown) is securely locked between the bed sections 14 and 16.

The slotted lock link 108 holds the main lock link 112 and the center angle 25 when the slotted lock link is activated to lock, by the main bellcrank. Then the main lock link 112 holds the front tube lock link 118 in such position (FIG. 2) that the front tube lock link 118 will hold the front tube or foot section, in the collapsed position of FIG. 2, to compress the mattress. Such construction is simpler and an improvement on previous pull out beds and is easier and less expensive to manufacture.

When moving from the position of FIG. 1 toward the position of FIG. 2, the foot section 16 is first moved to the dot-dash position of FIG. 1, the foot section swinging up in a counter clockwise direction, causing the front leg to swing in a clockwise direction toward the foot section, under the influence of the front leg link 124. As the bed is swung to FIG. 2, the center link swings up 90° about pivot 26, to vertical position, and the foot section swings, together with the center link, to horizontal position. In such position the foot section is locked and cannot be swung up alone without swinging the center link therewith.

From the position of FIG. 2, the bed can be moved to the position of FIG. 3, being then inclined downwardly and rearwardly. From FIG. 3 position, the bed can glide into the fully collapsed position of FIG. 4, such latter action being aided by the spring 72 which is tensioned when the bed is opened up. In going from FIG. 2 to FIG. 3, the rear legs are swung up in a clockwise direction relative to the long intermediate section 14.

In fully folded position of FIG. 4, the upper ends of rear legs 45, below pivot 46*g*, can rest on arms 65 of the main levers, this being the lowest position of the folded bed and hence the lowest level of the sofa seat.

Means is provided to raise the position of the fully folded bed, to thereby raise the level of the sofa seat. To this end, as shown in FIGS. 3*a* and 3*b*, an angle plate 130 can be fixed to top of arm 65, which is in a horizontal plane, in the fully collapsed position of the bed. Said angle 130 has a vertical flange 131 and a horizontal flange 132 attached to arm 65 by a screw 133. Flange 131 is of greater width than flange 132.

To get greatest height of the sofa seat, the attachment of angle 130 is as shown in FIGS. 3*a*, 3*b*. For a lesser height the angle 130 is attached, as in FIG. 3*c*, with the narrower flange 132 in vertical position, and the wider flange 131 in horizontal position.

For lowest adjustment of height of the sofa seat, the angle 130 is not used or removed.

The spring 72 is most fully tensioned in its fully collapsed position of FIG. 4, which aids in pulling out or opening the bed.

The locked position of sections 14, 15, 16 relative to each other remains between the positions of FIGS. 2, 3 and 4.

In the fully collapsed position of FIG. 4, the head section projects upwardly in back of the chassis and within the wood frame 11.

As the bed goes from FIG. 2 position to FIG. 3 position, the main bellcrank swings in a clockwise direction relative to the main angle 22, pulling the slotted lock link 108 to the left and lifting the rear leg 45 against the underside of the main angle through the rear leg link 111.

In the fully collapsed position of the bed (FIG. 4), the bed is supported by the chassis, since the links 75 are pivoted to the chassis at pivots 74, and arms 65 of the main levers 61 are pivoted to the chassis at 60.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. A folding pull out sofa bed comprising a rear head section, an intermediate section and means to pivot the front end of said head section to the rear end of said intermediate section, said head section extending rearwardly of said intermediate section in the open, sleeping position of said bed, and means to permit said head section to swing about said pivot means, from said rearwardly extending position to a position extending forwardly and overlying said intermediate section, and said means to permit said head section to swing about said pivot, comprising means to releasably lock said head section in an upwardly and rearwardly inclined T.V. position as a predetermined angle, said head section being swingable to said position extending forwardly and overlying said intermediate section when said releasably lock means is released, said releasably lock means including means to alternately lock and release said head section upon raising said head section from said rearwardly extending position through a greater angle than said predetermined angle, and then lowering said head section, a plurality of consecutive times.

2. A folding pull out sofa bed comprising a rear head section, an intermediate section and means to pivot the front end of said head section to the rear end of said intermediate section, said head section extending rearwardly of said intermediate section in the open, sleeping position of said bed, and means to permit said head section to swing about said pivot means, from said rearwardly extending position to a position extending forwardly and overlying said intermediate section, said bed also comprising another intermediate section extending from and pivoted to said first mentioned intermediate section, and a foot section extending from and pivoted to said another intermediate section, said foot section being swingable upwardly to vertical position relative to said another intermediate section, and said another intermediate section and said foot section then being foldable together to a position in which said another intermediate section extends vertically upwardly and said foot section extends rearwardly from the upper end of said another intermediate section, and overlies said first mentioned intermediate section, with said head section disposed between said first mentioned intermediate section and said foot section when said head section extends rearwardly in position overlying said first mentioned intermediate section, a main bellcrank pivoted to said first mentioned intermediate section and having a pair of arms, a slotted lock link pivoted to an arm of said main bellcrank, said slotted lock link being formed with a slot, a main lock link pivoted to said another intermediate section, said first mentioned intermediate section having a slot registering with the slot in said slotted lock link, in the open sleeping position of said bed, a pin on said main lock link passing through said registering slots, and a foot section lock link pivoted to said main lock link and also pivoted to said foot section.

3. The combination of claim 2, a rear leg pivoted to the pivotal connection between said first mentioned intermediate section and said another intermediate section, a rear leg link pivoted to said slotted lock link and to said rear leg, the pivotal connection of said rear leg link to said rear leg being spaced below the pivotal connection between the first mentioned intermediate section and said another intermediate section, in the open sleeping position of the bed.

4. The combination of claim 3, a front leg pivoted to said foot section, and a front leg link pivotally connected to said front leg and to said another intermediate section.

5. A folding pull out sofa bed comprising a rear head section, a long intermediate section pivoted to the front end of said head section, a short intermediate section pivoted to the front end of said long intermediate section, and a front foot section pivoted to the front end of said short intermediate section, all said sections being unfoldable to open, sleeping position, said head section being swingable from sleeping position up to T.V. position inclined upwardly and rearwardly, means to releasably support and lock said head section in said inclined T.V. position, and said head section being foldable forwardly into overlying position relative to said long intermediate section, said foot section being swingable up to vertical position relative to said short intermediate section, and said short intermediate section and said foot section, then being swingable together to a position in which said short intermediate section extends vertically upwardly from the front end of said long intermediate section, and said foot section projects rearwardly from the upper end of said short intermediate section and overlies said long intermediate section, with said head section between said long intermediate section and said foot section, a main bell crank pivoted to said long intermediate section and having a pair of arms, a slotted lock link pivoted to an arm of said main bellcrank, and said slotted lock link being formed with a slot, a main lock link pivoted to said short intermediate section, said long intermediate section having a slot registering with the slot in said slotted lock link in said open sleeping position of said bed, a pin on said main lock link passing through said registering slots, and a foot section lock link pivoted to said main lock link and to said foot section.

6. The combination of claim 5, a rear leg pivoted to the pivotal connection between said long intermediate section and said short intermediate section, and a rear leg link pivoted to said slotted lock link and to said rear leg, the pivotal connection of said rear leg link to said rear leg being spaced below the said pivotal connection between said long intermediate section and said short intermediate section.

7. The combination of claim 6, a front leg pivoted to said foot section, and a front leg link pivotally connected to said front leg and also pivotally connected to said short intermediate section.

8. The combination of claim 7, a second front leg pivoted to said foot section, a cross bar, a pair of gussets fixedly connected to the cross bar, and means for removably connecting said pair of gussets to said pair of front legs, respectively.

9. A folding pull out sofa bed comprising a rear head section, an intermediate section and means to pivot the front end of said head section to the rear end of said intermediate section, said head section extending rearwardly of said intermediate section in the open, sleeping position of said bed, and means to permit said head section to swing about said pivot means, from said rearwardly extending position to a position extending forwardly and overlying said intermediate section, said bed also comprising another intermediate section extending from and pivoted to said first mentioned intermediate section, and a foot section extending from and pivoted to said another intermediate section, said foot section being swingable upwardly to vertical position relative to said another intermediate section, and said another intermediate section and said foot section then being foldable together to a position in which said another intermediate section extends vertically upwardly and said foot section extends rearwardly from the upper end of said another intermediate section, and overlies said first mentioned intermediate section, with said head section disposed between said first mentioned intermediate section and said foot section, front legs pivoted to said foot section, a cross bar, gussets fixed to the cross bar, and removable means for attaching said gussets to said front legs.

10. The combination of claim 9, bumpers, and means to removably attach said bumpers to the respective ends of said cross bar.

11. A folding pull out sofa bed comprising a pair of symmetrical chassis, symmetrical main levers pivoted to the chassis, a head section, a first intermediate section, a second intermediate section, and a foot section, means to pivot the head section to the first intermediate section, means to pivot the second intermediate section to the first intermediate section and means to pivot the foot section to the second intermediate section, said sections being movable to an open, sleeping position of the bed, said bed being foldable to a position in which the first intermediate section is at the bottom, with the head section projecting up from the rear end of said first intermediate section, the second intermediate section projecting up from the front end of said first intermediate section and the foot section extending rearwardly from the upper end of said second intermediate section and over said first intermediate section, coil tension springs interconnecting said main levers to said chassis, respectively, said main levers each having an arm extending upwardly from the pivot points of said main levers to said chassis, second arms extending rearwardly from the lower ends of the first mentioned arms of said main levers, and third arms extending transversely of the bed inwardly from said second mentioned arms of said main lever, toward each other and beneath said first intermediate section, when the bed is in fully folded condition, and supporting said folded bed.

12. The combination of claim 11, and means attached to said third arms of said main levers to raise the vertical position of said folded bed supported on said third arms.

13. The combination of claim 12, said raise means attached to said third arms each comprising an angle having a wider flange and a narrower flange, and means to selectively attach one of the flanges to a third arm with the other flange extending upwardly.

14. The combination of claim 13, rear legs pivoted to the pivotal connections between said first and second intermediate sections and foldable beneath said first intermediate section, and said front legs being engaged by said upwardly extending flanges.

15. The combination of claim 11, and a cross member interconnecting said inwardly extending third arms of said main levers.

16. The combination of claim 15, and means attached to said third arms of said main levers to raise the vertical position of said folded bed supported on said third arms.

17. A folding pull out sofa bed comprising a rear head section, an intermediate section and means to pivot the front end of said head section to the rear end of said intermediate section, said head section extending rearwardly of said intermediate section in the open, sleeping position of said bed, and means to permit said head section to swing about said pivot means, from said rearwardly extending position to a position extending forwardly and overlying said intermediate section, and means to releasably lock said head section in an upwardly and rearwardly inclined T.V. position at a predetermined angle, said means comprising, a link pivoted to said intermediate section, and disconnectible means to pivot said link to said head section.

18. The combination of claim 17, and butterfly locking means controlled by said link when said link is pivotally connected to said head section, to alternately lock and release said head section upon consecutively raising and lowering said head section a plurality of times.

19. A pull out sofa bed comprising a head section, a long intermediate section pivoted to the front end of said head section, a short intermediate section pivoted to the front end of said long intermediate section, a foot section pivoted to the front end of said short intermediate section, a chassis, a main lever pivoted to said chassis, a rear swing link pivoted to said chassis rearwardly of and above the pivotal connection of said main lever to said chassis, a rear control link pivoted to said rear swing link, a rear throwout link pivoted to said rear swing link, the pivotal connection of said rear control link to said rear swing link being disposed between the pivotal connections of said rear swing link to said chassis and to said rear throwout link, said main lever having an arm pivoted to said rear throwout link, a rear guide link pivoted to the pivotal connection of the head section to the long intermediate section, and also pivoted to said rear control link, a main bellcrank pivoted to said long intermediate section and having a first arm pivoted to said rear throwout link, and also having a second arm, a slotted lock link pivoted to said second arm of said main bellcrank, said slotted lock link having a slot, said long intermediate section having a slot registering with the slot in said slotted lock link in the open, sleeping position of the bed, a main lock link pivoted to said short intermediate section and carrying a pin passing through said registering slots, and a foot section lock link pivoted to said main lock link and to said foot section.

20. The combination of claim 19, a rear leg pivoted to the pivotal connection between said long intermediate section and said short intermediate section, and a rear leg link pivoted to said rear leg and to said slotted lock link.

21. The combination of claim 20, a front leg pivoted to said foot section, and a front leg link pivoted to said front leg and to said short intermediate section.

22. The combination of claim 19, said pin being at the front ends of said registering slots in the open sleeping position of said bed.

23. The combination of claim 19, the pivotal connection of said main lock link to said short intermediate section being above the level of said long intermediate section, in the open sleeping position of said bed.

24. The combination of claim 19, said long intermediate section being formed with another slot, a T.V. support link carrying a pin slidable in said another slot, means to releasably connect said T.V. support link to said head section, a head section control link pivoted to said T.V. support link by means of said pin on said T.V. support link, and said head section control link having a pin and slot connection to said rear guide link.

25. The combination of claim 19, and tension spring means connecting said main lever to said chassis.

26. The combination of claim 19, said main lever having an arm extending rearwardly from said first arm of said main lever in the open, sleeping position of said bed, and said main lever having a third arm extending transversely inwardly in said open sleeping position of said bed, and said bed, when completely folded being supported on said third arm of said main lever.

27. The combination of claim 19, said head section being foldable to overlie the long intermediate section.

28. The combination of claim 27, and means to releasably lock said head section in upwardly and rearwardly inclined T.V. position.

29. A folding pull out sofa bed comprising a rear head section, an intermediate section and means to pivot the front end of said head section to the rear end of said intermediate section, said head section extending rearwardly of said intermediate section in the open, sleeping position of said bed, and means to permit said head section to swing about said pivot means, from said rearwardly extending position to a position extending forwardly and overlying said intermediate section, a main bellcrank pivoted to said first mentioned intermediate section and having a pair of arms, a slotted lock link pivoted to an arm of said main bellcrank, said slotted lock link being formed with a slot, a main lock link pivoted to said another intermediate section, said first mentioned intermediate section having a slot registering with the slot in said slotted lock link, in the open sleeping position of said bed, a pin on said main lock link passing through said registering slots, and a foot section lock link pivoted to said main lock link and also pivoted to said foot section, said bed being foldable to a position in which said another intermediate section projects up from the front end of said first mentioned intermediate section, and said foot section extends rearwardly from the upper end of said another intermediate section and is disposed above said first mentioned intermediate section, said bed in said folded position, being locked against raising said foot section without swinging said intermediate section forwardly down toward horizontal position, by said pin in said registering slots being at the rear ends of said slots, by said foot section lock link being inclined upwardly and rearwardly from said main lock link to said foot section and said main lock link carrying said pin at the rear ends of said registering slots and by being pivoted to said another intermediate section.

30. A pull out sofa bed comprising a head section, an intermediate section and a foot section, legs pivoted to said foot section, a cross rod, gussets fixed to the ends of said cross rod, and means to detachably attach said gussets to the lower ends of said legs.

31. The combination of claim 30, bumpers and means to removably attach said bumpers to the underside of the cross rod adjacent the ends of said cross-rod.

32. A sofa pullout bed comprising, a first section, a second section pivoted at its rear end to the front end of said first section, a foot section pivoted to the front end of said second section, a slotted link having a slot, said first section having a slot registering with said slot in said slotted link, a main lock link pivoted to said second section and carrying a pin fixed thereto and slidably received in said registering slots and disposed at the front ends of said registering slots in the open sleeping position of said bed with said first, second and head sections in horizontal position, a foot section lock link pivoted at its rear end to the front end of said main lock link and at its front end to said foot section, in said open sleeping position of said bed, said second section extending upwardly from the front end of said first section, and said foot section extending rearwardly from the upper end of said second section, and over said first section, in a folded position of said bed, and said pin moving to the rear ends of said slots, in said folded position of said bed, and said main lock link crossing said second section in said folded position of the bed, and said foot section lock link being inclined upwardly and rearwardly from its pivotal connection to said main lock link to its pivotal connection to said foot section, to lock said foot section against upward swinging movement in the folded position of the bed, without swinging said second section downwardly and forwardly toward horizontal position.

33. The combination of claim 32, a rear leg pivoted to the pivotal connection of said first and second sections, a rear leg link pivotally connected at its rear end to said slotted lock link and at its front end to said rear leg, and means on the bed to pull said slotted lock link rearwardly to cause said rear leg to be pulled against the underside of said first section by said rear leg link.

* * * * *